United States Patent [19]

Kaalstad et al.

[11] Patent Number: 4,790,397

[45] Date of Patent: Dec. 13, 1988

[54] ROTARY DRILLING DEVICE

[75] Inventors: Oscar Kaalstad, Winterpark, Fla.; Neil G. Reid, Whiteleaf Aylesbury, Great Britain

[73] Assignee: Cledisc International BV, Amsterdam, Netherlands

[21] Appl. No.: 47,420

[22] Filed: May 6, 1987

[51] Int. Cl.[4] ..... E21B 10/08

[52] U.S. Cl. ..... 175/365; 175/376

[58] Field of Search ..... 175/365, 336, 343, 356, 175/373, 374, 376, 331, 342, 408

[56] References Cited

U.S. PATENT DOCUMENTS

| | | | |
|---|---|---|---|
| 1,124,243 | 1/1915 | Hughes | 175/365 |
| 1,152,151 | 8/1915 | Decker . | |
| 1,391,626 | 9/1921 | Gilthorpe . | |
| 1,852,843 | 4/1932 | Greve | 175/334 |
| 1,879,127 | 9/1932 | Schlumpf | 175/376 X |
| 2,151,545 | 3/1939 | Zublin . | |
| 2,325,459 | 7/1943 | Zublin | 175/338 |
| 2,330,083 | 9/1943 | Sewell . | |
| 3,424,258 | 1/1969 | Nakayama | 175/376 X |
| 4,285,409 | 8/1981 | Allen | 175/336 |
| 4,416,339 | 11/1983 | Baker et al. | 175/61 |
| 4,444,281 | 4/1984 | Schumacher, Jr. et al. | 175/336 |
| 4,549,614 | 10/1985 | Kaalstad et al. | 175/339 |

FOREIGN PATENT DOCUMENTS

| | | |
|---|---|---|
| 509329 | 2/1955 | Canada . |
| 582314 | 11/1977 | U.S.S.R. . |

*Primary Examiner*—Hoang C. Dang

*Attorney, Agent, or Firm*—Hoffmann & Baron

[57] ABSTRACT

A rotary drilling device is disclosed of the type having a body connected to a rotary drive system for rotation about a primary axis in order to bore into the ground to form a cylindrical hole. The device has a rotary cutting member mounted on one side near the bottom of the body for rotation about an inclined axis of rotation which forms an angle with the primary axis of rotation. A counter-reaction member is disposed on the side of the body away from that carrying the cutting member and near its bottom. The counter-reaction member is constructed and positioned so as to be in contact with only the concave bottom of the hole and so that the maximum radial projection from the primary axis of rotation of any part of the counter-reaction member is less than the radius of the hole, with the highest point of the surface of contact between the counter-reaction member situated below a line defined by the intersection between the concave bottom of the hole and its cylindrical side wall. The counter-reaction member has a convex surface in contact with and closely conforming to the concave surface of the bottom of the hole.

10 Claims, 5 Drawing Sheets

ROTARY DRILLING DEVICE

FIELD OF THE INVENTION

The present invention relates generally to earth boring equipment and, more particularly, concerns a rotary drilling device comprising a body having on its lower part, a laterally protruding, rotary cutting member which has an axis of rotation that forms an angle with the axis of rotation of the body, a counter-reaction member disposed on the side of the body opposite that carrying the cutting disc.

BACKGROUND OF THE INVENTION

A device of this general type is described in our U.S. Pat. No. 4,549,614. The device described is this document has been tested and has yielded very good results. Nevertheless, it has become apparent that these results could be improved still further by modifying the shape of the counter-reaction member and its position in relation to the cutting disc. The counter-reaction member described in U.S. Pat. No. 4,549,614 is either a roller or a friction member which bears primarily on the cylindrical wall of the drilled hole in order to compensate the radial component of the reaction of the ground on the cutting disc. This centers the head and strengthens the cylindrical wall of the hole. However, depending upon the nature of the ground, the cutting head sometimes tends to enter too far into the ground, under the effect of the load to which it is subjected, and this can cause an overload or even a seizure of the means producing the rotation of the drilling head. Also, the head can deviate from the required drilling line owing to slippage of the device on the ground at the bottom of the hole, this bottom not having been compacted after the disc has passed through.

The purpose of the present invention is to overcome these disadvantages by providing a drilling device having a counter-reaction member which eliminates the above-mentioned disadvantages by virtue of its shape and its arrangement.

The drilling device according to the invention is principally characterized in that the counter-reaction member is arrnged so as to be in contact with only the concave bottom of the hole and so that, with respect to the axis of rotation of the body, the maximum radial projection of any part of the counter-reaction member and its means of attachment to the body is less than the maximum radial projection of the teeth on the cutting disc. This maximum radial projection of the counter-reaction member is therefore less than the radius of the hole generated by the device. As a result, the highest point of the surface of contact between the counter-reaction member and the hole is situated below the line at which the curved bottom of the hole meets the cylindrical wall of the hole. Also, the lowest point of the surface of contact between the counter-reaction member and the hole is separated from the axis of rotation of the body by a distance which is preferably, but not essentially, greater than the distance from the lowest point of the cutting disc to the same axis. Furthermore, the surface of contact of the counter-reaction member is convex and closely matches the concave surface of the bottom of the hole.

The advantages of the device according to the invention are the following: since the counter-reaction member is arranged on the body so as to be in contact with only the concave bottom of the hole, the withdrawal of the drilling device from the hole is made easier because, between the counter-reaction member and the cylindrical wall of the hole, there is a space. This space may also be useful in providing passage for the removal of the debris from the hole by means of the drilling fluid.

A further advantage of the device is that the contact between the counter-reaction member and the bottom of the hole serves to remove any irregularities in the concave shape of the bottom left by the previous passage of the cutting disc, by smoothing off any projecting peaks and compacting the surface of the hole in readiness for the next passage of the cutting disc. This action of reshaping and compacting the concave surface of the bottom of the hole reduces the risk of deviation from the required drilling axis. If the drilling device is not fitted with a counter-reaction member to perform this function, it may be subject to deviation from the drilling axis caused by diversion of the cutting disc from its true path by peaks and hollows in the irregular bottom of the hole or by slippage of the cutting disc into pockets of lower resistance in an uncompacted hole bottom.

Yet a further advantage of the device, according to a preferred embodiment, is that the surface of contact of the counter-reaction member is so positioned in relation to the cutting disc that it prevents the teeth on the disc from entering the ground at the cutting face by more than a predetermined depth. An efficient, steady and quick drilling operation is best achieved when the cutting teeth on the disc are constrained to partial entry into the ground, rather than to the full depth of the teeth, because, on the one hand, the debris cut away is smaller and thereby easier to remove by means of the drilling fluid, and, on the other hand, it is known that the cutting action of the teeth is more efficient and requires the application of less force, thereby preventing the overloading of the means for driving the device in rotation.

The surface of the counter-reaction member in contact with the concave bottom of the hole may be so shaped that it maintains continuous contact with the hole over its entire area. In this form, the counter-reaction member may be made from a material, such as hardened steel, which is suitably resistant to withstand the abrasion resulting from contact with the bottom of the hole during operation.

In another arrangement, the surface of the counter-reaction member may have interspersed on it a pattern of hard studs, as might be made from tungsten carbide, which project from the surface of the counter-reaction member by a typical distance of 2 mm or more. This provides flow-through channels for the flushing fluid between the surface of the counter-reaction member and the bottom of the hole for purposes of cooling the counter-reaction member and for the removal of fine debris from the cutting face. These studs might be arranged in an alternate overlapping pattern so as to provide a complete sweeping effect over the bottom of the hole between the highest and lowest points of contact of the counter-reaction member, thereby performing the aforementioned smoothing operation of the hole bottom most effectively. Alternatively, in some types of ground, it may be preferable to arrange the studs in spaced pairs with the studs of each pair being radially aligned with one another from the axis of rotation of the drilling device. This pattern provides uninterrupted flow-through channels in the space between each pair of studs for efficient cooling and debris removal.

In a preferred arrangement, the rotational axis of the cutting disc relative to the body is displaced from the axis of rotation of the device, so that the cutting disc is positioned to provide some "lead" in the direction of rotation by means of a concentric arrangement. This displacement ensures that cutting is performed by the leading teeth on the disc and that clearance exists between the trailing teeth and the hole to prevent the stalling of the disc in rotation. Such stalling might be caused by engagement of the trailing teeth with the hole if "lead" were not provided. This displacement also facilitates removal of debris in the clearance thus created behind the disc. With this arrangement, cutting is performed by the teeth in the lower leading, or cutting, quadrant of the disc and, accordingly, the preferred position of the counter-reaction member is diametrically opposite to the cutting quadrant through the axis of rotation of the device. In this position, the counter-reaction member is best equipped to resist and counteract the radial forces imposed by the ground on the device at the cutting face and thus to prevent deviation or wander from the required drilling axis.

According to yet another embodiment, the directional stability of the drilling axis is further assured by the provision of two counter-reaction members radially positioned, typically, at 120 degrees with respect to each other and to the cutting quadrant on the disc. In its simplest and most economic arrangement, the counter-reaction member may be formed integrally with the body of the device, as could be produced by the inclusion of the shapes of both the body and the counter-reaction member in a single steel casting.

However, the surface of the counter-reaction member which contacts the bottom of the hole can be subject to severe wear during use of the device, and this surface may degrade to the point at which premature unserviceability of another usable body is caused. In a preferred embodiment, therefore, the counter-reaction member is provided as a separate component from the body and means are provided for location and assembly thereto. In the event that wear of the counter-reaction member progresses to the point of impairment of function, it can be removed from the body and replaced with a new counter-reaction member, to enable continued use of the drilling device.

Yet a further embodiment provides for the attachment of the counter-reaction member to the body in such a manner that the position of the counter-reaction member may be adjusted in relation to the cutting disc, in order to achieve the optimum position for efficient cutting. This may be done by mounting the counter-reaction member in slide locations formed in the body so as to be aligned with the axis of rotation of the device, and securing to the body by means of an adjusting screw. The height of the counter-reaction member relative to the cutting disc may then be varied to suit the nature of the ground being drilled.

BRIEF DESCRIPTION OF THE DRAWINGS

The drilling device is now described in greater detail with the aid of the attached drawings, in which.

DETAILED DESCRIPTION OF THE PREFERRED EMBODIMENTS

Figure 1:
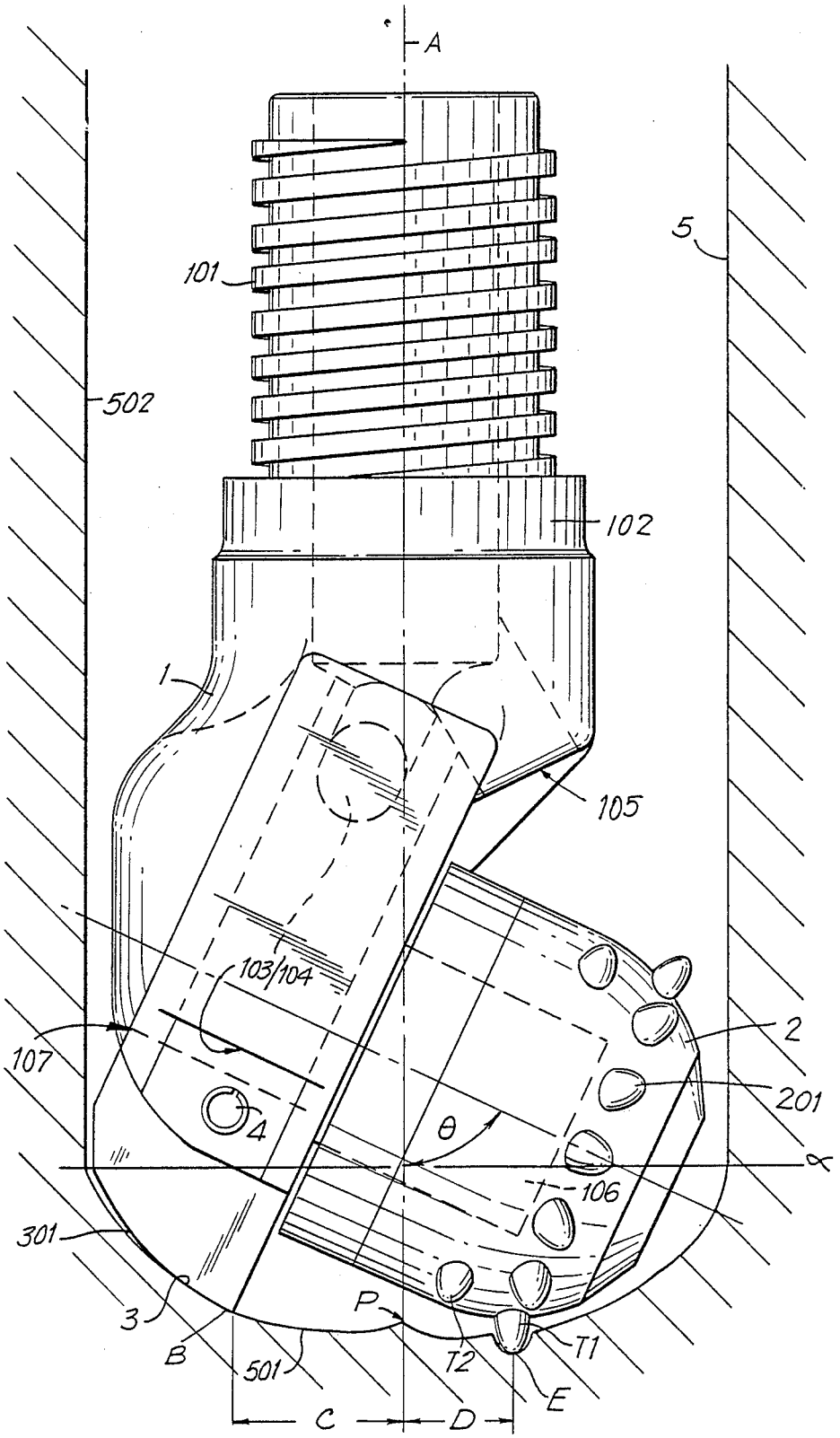
FIG. 1 shows a side view of the drilling device and its relationship to the hole drilled.

The drilling device comprises mainly a body 1, a rotary cutting disc 2, and a counter-reaction member 3.

On its upper part, body 1 is provided with a thread 101, to effect its connection to the rotary driving means usually employed in drilling. A conduit 102, for circulating the drilling fluid under pressure, passes through the body 1. The conduit 102 ends in a conduit 103 which is displaced from axis of rotation A and opens into an orifice 104 to direct drilling fluid to the bottom of the hole, between the cutting member of disc 2 and counter-reaction member 3, in order to remove debris produced at the cutting face by the action of the disc 2. Another branch from conduit 102 opens into an orifice 105 which directs drilling fluid across the cutting face of disc 2 to clear debris away from teeth on the disc, so as not to impair their cutting action, and it also assists in the cooling of the disc.

On the lower part of body 1 is fitted a cylindrical axle 106 having an axis set at an angle $\theta$ to the axis of rotation A of the body 1. In conjunction with the design of disc 2 and the configuration of cutting teeth thereon, angle $\theta$ is preferably between 60 and 70 degrees and is chosen to ensure that the sweep of the cutting teeth, and the rotation of both the drilling device as a whole and also of disc 2, covers the entire area of the hole being drilled. Cutting disc 2 is fitted for angular rotation on axle 106 using known means, such as plain journal, ball or roller bearings.

On the side of body 1 opposite to that carrying axle 106 is situated counter-reaction member 3. FIG. 1 shows counter-reaction member 3 as a separate component which is fitted to body 1 by means of a location slot 107 therein, which may be angularly displaced from axis of rotation A as shown, and by pin 4 which passes through holes in both body 1 and counter-reaction member 3 to secure the latter in position. By these means, counter-reaction member 3 may be removed from body 1, by removal of pin 4 and withdrawal from slot 107, and then replaced by a new counter-reaction member, such replacement might be occasioned if the used counter-reaction member has experienced excessive wear or, alternatively, if the drilling application and the type of disc 2 fitted to the device necessitates a counter-reaction member of a different shape.

As an alternative arrangement, which is both simpler and more economic, counter-reaction member 3 can be formed as an integral part of body 1 for any applications in which the replacement of counter-reaction member 3 is not deemed to be necessary during the useful life of the drilling device. This is not specifically illustrated but, from FIG. 1, it can be easily seen that the shape designated as counter-reaction member 3 could form part of body 1 as might be done, for example, if body 1 is produced as a casting.

The lower face 301 of counter-reaction member 3 maintains contact with the concave bottom 501 of the hole 5. Additionally, the maximum radial projection from axis of rotation A of any part of counter-reaction member 3 and the body 1 to which counter-reaction member 3 is attached is less than the maximum radial projection of the teeth 201 on disc 2 and thereby is less than the radius of the cylindrical wall 502 of the hole being drilled. Thereby, the contact surface between the lower face 301 and counter-reaction member 3 of the bottom 501 of the hole 5 is always below the line along which the curved bottom 501 of the hole 5 meets the cylindrical wall 502, this line being situated on theoretical plane $\alpha$. This plane passes through the most forward tooth on the cutting disk in the direction of rotation of the device, as illustrated in FIG. 1. That tooth generates the resultant diameter of the hole.

Preferably, the lowest point B of the lower face 301 of the counter-reaction member 3 that contacts the concave portion of the hole is at a radial distance C from axis of rotation A to point E, the lowest point of contact of the disc 2 with the ground (at the tip of tooth T1). This relationship between distances C and D is preferred, because within the intended cutting geometry of the device, a peak P is allowed to form in the profile of the hole bottom between point E and the axis of rotation A, and counter-reaction member 3 will not function optimally unless B, its lowest point of contact with the bottom of the hole, is at a greater radial distance from axis of rotation A than point E. This avoids interference of the lower face 301 of counter-reaction member 3 with the aforementioned peak.

Figure 2B:
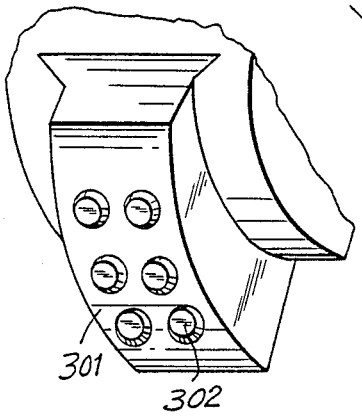
FIGS. 2B and 3B are fragmentary perspective views showing the counter-reaction members corresponding to FIGS. 2A and 3A, respectively.
Figure 2A:
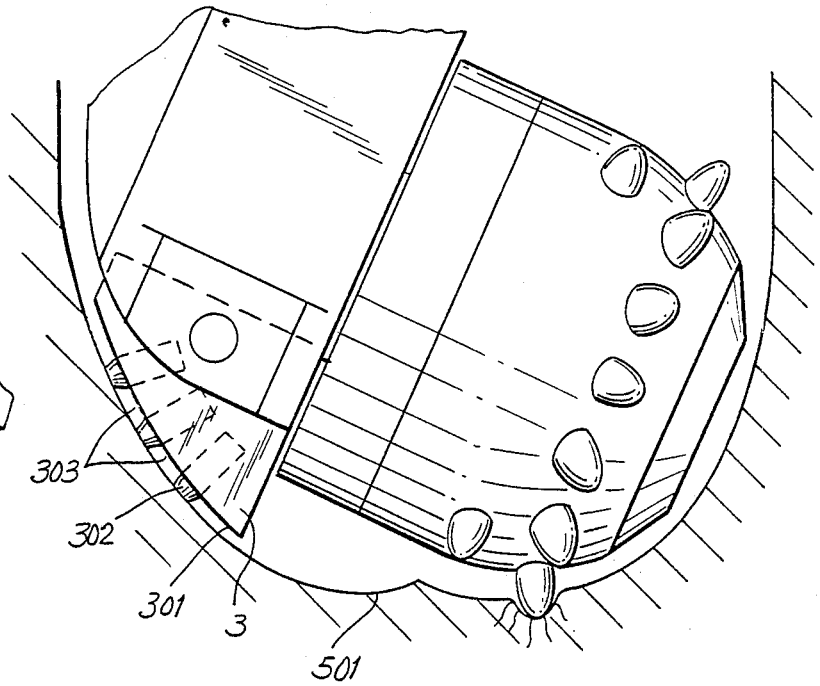
FIGS. 2A and 3A show fragmentary views of the lower portion of the device in side elevation, to illustrate alternative patterns of stud inserts in the counter-reaction member.
Figure 3B:
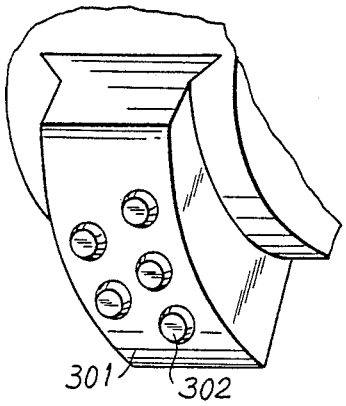
Figure 3A:
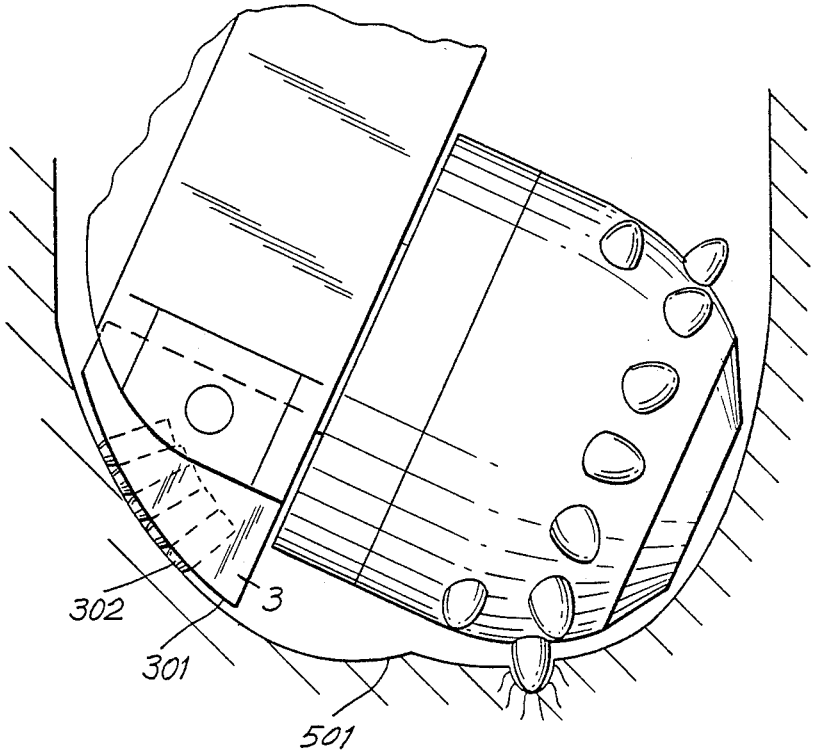

The lower face 301 of counter-reaction member 3 may be so shaped that it is in continuous contact with the concave bottom 501 of the hole 5 as shown in FIG. 1. Alternatively, FIGS. 2A, 2B and 3A, 3B show arrangements in which lower face 301 of counter-reaction member 3 is interspersed with patterns of projecting, hardened studs which themselves maintain contact with the bottom of the hole and thus cause face 301 to be lifted clear thereof. FIGS. 2A and 2B show an arrangement in which the hardened studs 302, which may be made from tungsten carbide or like material, are inserted into the lower face 301 of counter-reaction member 3 in spaced pairs, the studs of each pair being radially aligned with one another from the axis of rotation of the drilling device, thus creating uninterrupted flow-through channels 303 in the space between each pair of studs. These channels 303 provide passages through which the drilling fluid may flow in order to cool counter-reaction member 3 and also to flush away debris produced at the cutting face. FIGS. 3A and 3B show an arrangement whereby the studs 302 are arranged in an alternating pattern so as to provide a complete sweeping effect over the bottom 501 of the hole between highest and lowest points of surface 301 on counter-reaction member 3, and they thereby perform the aforementioned smoothing and compacting operation on the bottom 501 of the hole most effectively.

Disc 2 is typically made from toughened steel and carries teeth 201 which perform the cutting operation in the hole. The teeth 201 may either be formed integral with disc 2, by the machining of disc 2 itself and hardening thereafter, or by the insertion of hard metal studs, made for example from tungsten carbide, into preformed holes in the disc 2, this latter arrangement being shown in FIG. 1. Thus secured into the disc 2, the studs project from the surface of disc 2 to form the teeth 201, the projecting portion being profiled in such a way as to provide an efficient cutting action. The cutting teeth 201 are arranged in two peripheral rows around the surface of disc 2 perpendicular to the axis of rotation of the disc. The outer row of teeth, most distant from the axis of rotation A of the device, and of which tooth T1 is a part, includes most of the teeth in the disc 2 and performs the major cutting action of the device. The inner row of teeth, of which tooth T2 is a part, performs a secondary cutting action which is described hereafter.

E is the lowest point of the disc 2 and, in principle therefore, the point which carries the greatest load, since it is the lowest tooth T1 of the teeth 201 entering the ground (FIG. 1). The tooth T2 is situated slightly higher and its function is to break and remove the peak P which is deliberately created, as a result of the relative positions of the rows of teeth, in the middle of the concave bottom 501 of the hole 5. Peak P is useful because, as described in U.S. Pat. No. 4,549,614, it assists in keeping the drilling device central on the axis of rotation A. However, peak P must be cut away as drilling progresses, and this task is performed by the teeth T2.

Figure 4:
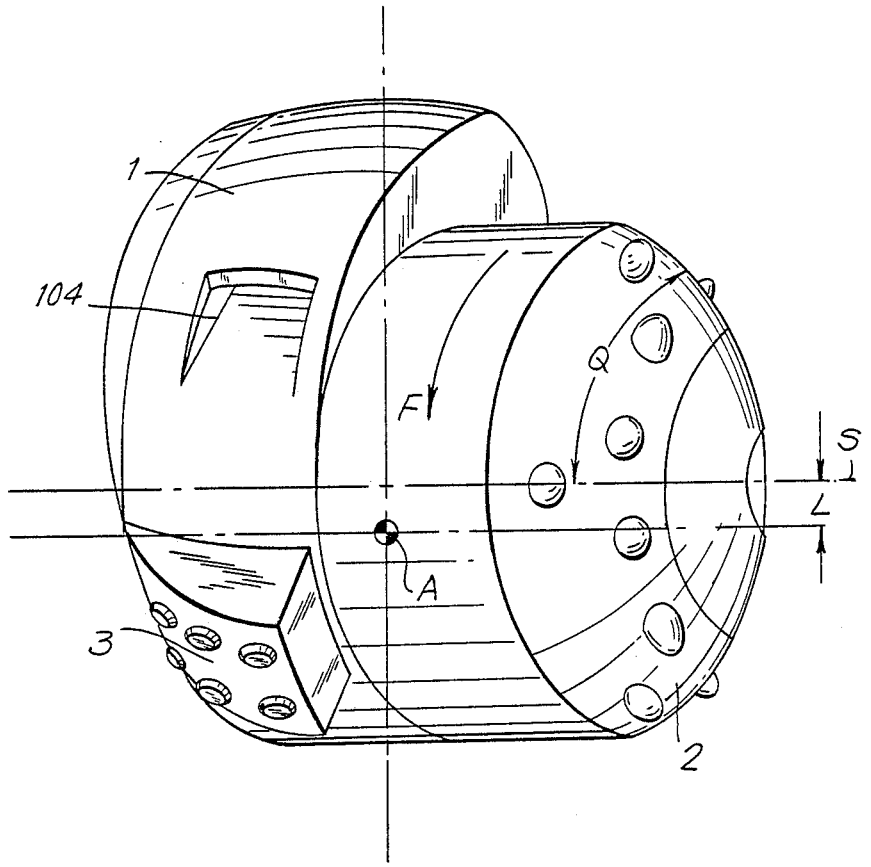
FIGS. 4 and 4A are perspective views of the underside of the drilling device.

FIG. 4 shows a view of the drilling device as seen from the underside. In a preferred embodiment, the rotational axis S of the cutting disc is displaced from the axis of rotation A of the drilling device in the direction of rotation about that axis, so as to provide a "lead" of distance L in the direction of rotation F. This displacement ensures that the cutting is performed by the leading teeth on the disc and that clearance exists between the trailing teeth and the hole produced by the device. This prevents the disc from stalling in rotation, which might otherwise be caused by engagement of the trailing teeth with the hole if lead L were not provided. Lead L also facilitates the removal of debris produced at the cutting face in the clearance created behind the disc.

With this arrangement, cutting is performed by the teeth in the lower leading quadrant Q of the disc, this being defined as the peripheral arc around the outer row of teeth 201 between the most forward tooth on the row in the direction of rotation F of the device and the lowest tooth T1. Accordingly, the preferred position of counter-reaction member 3 is diametrically opposite to the cutting quadrant Q through the axis of rotation A of the device. In this position, counter-reaction member 3 is best equipped to resist and counteract the radial forces imposed by the ground on the device at the cutting face and thus prevent deviation or wander from the required drilling axis.

Figure 4A:
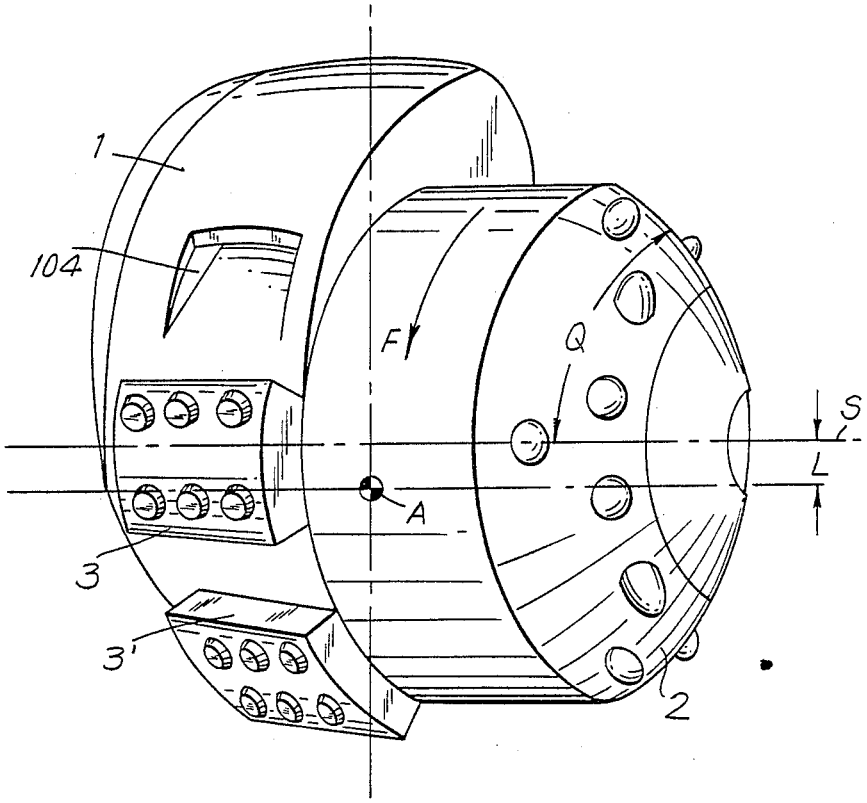

In yet another embodiment, the directional stability of the drillng axis is further assured by the provision of two counter-reaction members 3 and 3', as shown in FIG. 4A, the positions of which are preferably at the same height, but are displaced by 120 degrees with respect to each other and with respect to cutting disc 2.

Another important feature of the device is that the counter-reaction member 3 can be positioned in height relative to the cutting disc 2 so as to prevent teeth T1 from entering the ground by more than a predetermined distance, since the most efficient cutting performance has been found to be obtained when teeth T1 are only permitted partial entry into the ground. Furthermore, such limitation of entry into the ground by the action of counter-reaction member 3 will prevent shearing off of the teeth T1 as might otherwise occur if there were not limitation of entry. In order to take account of the differences which can occur in the extent of optimum tooth entry according to the nature of the ground, and also to make provision for the possible need for variations in the profile and projection of teeth T1 from disc 2 for drilling in different types of ground, an arrangement is described whereby counter-reaction member 3 is mounted on body 1 in such a manner that the height of surface 301 on counter-reaction member 3 may be adjusted relative to cutting disc 2.

Figure 5:
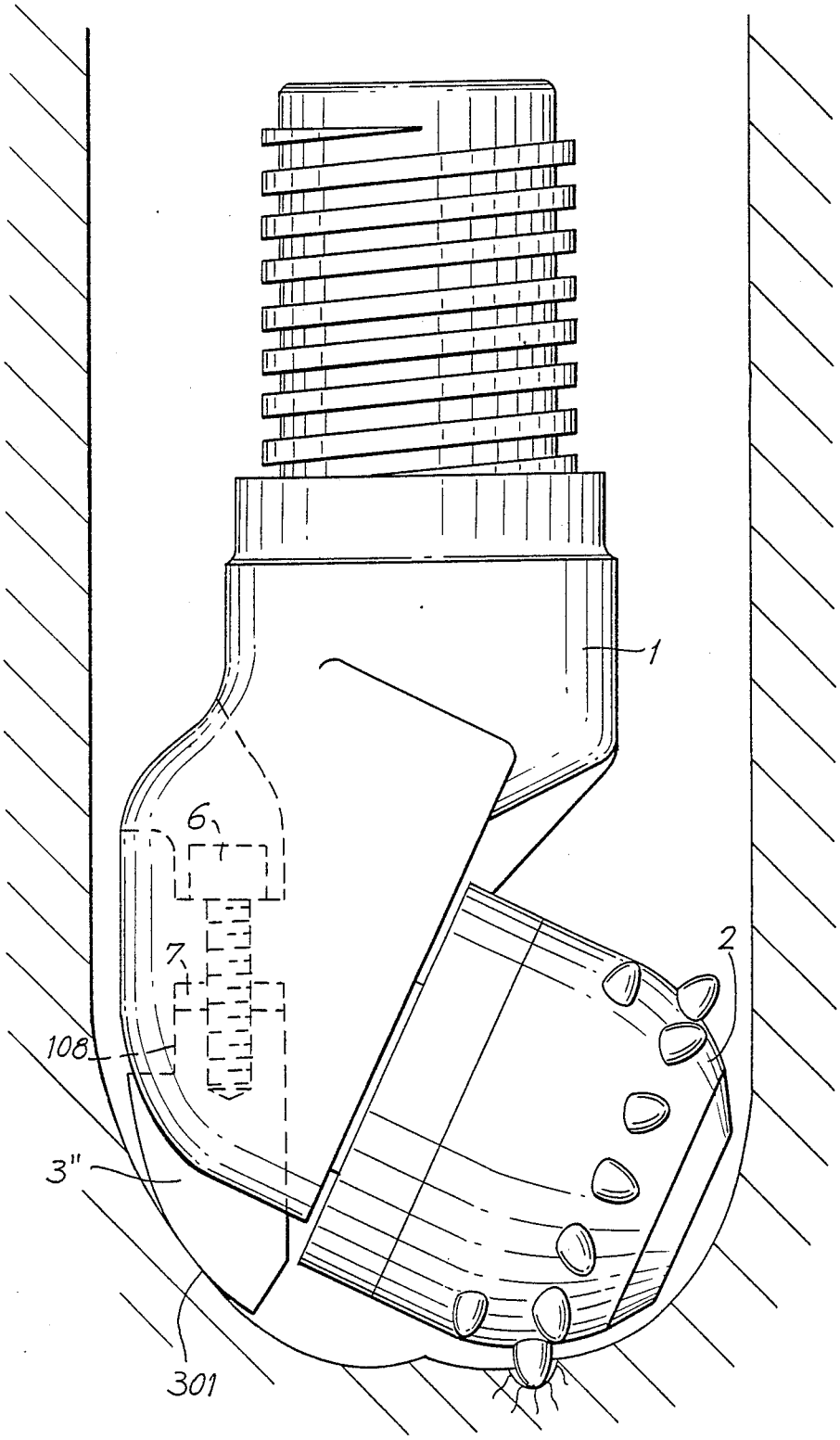
FIG. 5 is a side view, similar to FIG. 1, showing a drilling device is which the counter-reaction member is adjustable in height relative to the cutting disk.

FIG. 5 shows such an arrangement wherein counter-reaction member 3″ is shaped to be received in a vertical slot 108 of body 1 and is secured therein for adjustability in height with respect to cutting disc 2, by means of screw 6. The adjustment in height of surface 301 relative to cutting disc 2 in this arrangement is maintained by making use of a spacer or packing washer 7, the thickness of which may be varied according to the height required.

Although preferred forms of the invention have been disclosed for illustrative purposes, those skilled in the art will appreciate that many additions, modifications, and substitutions are possible, without departing from the scope and spirit of the invention, as defined in the accompanying claims.

What is claimed is:

1. A rotary drilling device of the type having a body connected to a rotary drive system for rotation about a primary axis in order to bore into the ground to form a cylindrical hole having a bottom and side wall, said device comprising:

a rotary cutting member mounted on one side near the bottom of said body for rotation about an inclined axis of rotation which forms an angle with the primary axis of rotation, the cutting member being inclined towards the bottom and the side wall of the hole, the cutting member being shaped to form a hole with a substantially concave bottom; and a counter-reaction member disposed on the side of the body away from that carrying said cutting member and near the bottom thereof, the counter-reaction member being constructed and positioned so as to be in contact with only the concave bottom of the hole and so that the maximum radial projection from the primary axis of rotation of any part of said counter-reaction member and its means of attachment to said body is less than the radius of the hole, with the highest point of the surface of contact between said counter-reaction member and the hole being situtated below a line defined by the intersection between the concave bottom of the hole and its cylindrical side wall, said counter-reaction member having a convex surface in contact with and closely conforming to the concave surface of the bottom of the hole.

2. A device according to claim 1 said counter-reaction member is constructed so that the lowest point of the surface of contact between said counter-reaction member and the hole is separated from the primary axis of rotation of the body by a distance C which is greater than the distance D from the lowest point of the cutting member to the primary axis.

3. A device according to claim 1 wherein the counter-reaction member is positioned in height on said body so as to prevent the entry of the cutting member into the ground beyond a predetermined depth.

4. A device according to claim 4 wherein the cutting member includes a plurality of cutting teeth mounted thereon, wherein a portion of the cutting member defines a cutting quadrant in which cutting of the ground is performed by the teeth situated therein, and wherein the surface of contact of the counter-reaction member with the ground is approximately diametrically opposite the cutting quadrant of the cutting member.

5. A device according to claim 1, wherein said body is connected to receive drilling fluid from a source thereof, and wherein the counter-reaction member includes a plurality of hardened inserts which project slightly from a surface thereof to allow contact of the inserts with the concave bottom of the hole and to create a small passage between the counter-reaction member surface and the concave bottom of the hole, through which passage drilling fluid may flow.

6. A device according to claim 5 wherein the cutting member includes a plurality of cutting teeth mounted thereon, wherein a portion of the cutting member defines a cutting quadrant in which cutting of the ground is performed by the teeth situated therein, and wherein the surface of contact of the counter-reaction member with the ground is approximately diametrically opposite the cutting quadrant of the cutting member.

7. A device according to claim 5 wherein said body further comprises a conduit for the drilling fluid, said conduit including an orifice of the conduit arranged so as to direct a jet of fluid between the cutting member and the counter-reaction member and over a portion of said cutting member.

8. A device according to claim 5 which further comprises means for adjustably positioning the counter-reaction member with respect to the body, the adjustable positioning means including a screw mounted on the body, the counter-reaction member being received by a slot formed in the body and secured therein by the screw, the adjustable positioning means further including a spacer, the spacer being disposed between the counter-reaction member and the body and having a pre-selected thickness so that the counter-reaction member extends from the slot a predetermined distance.

9. A device according to claim 1 wherein said body further comprises a conduit for the drilling fluid, said conduit including an orifice of the conduit arranged so as to direct a jet of fluid between the cutting member and the counter-reaction member and over a portion of said cutting member.

10. A device according to claim 1 which further comprises means for adjustably positioning the counter-reaction member with respect to the body, the adjustable positioning means including a screw mounted on the body, the counter-reaction member being received by a slot formed in the body and secured therein by the screw, the adjustable positioning means further including a spacer, the spacer being disposed between the counter-reaction member and the body and having a pre-selected thickness so that the counter-reaction member extends from the slot a predetermined distance.

* * * * *

UNITED STATES PATENT AND TRADEMARK OFFICE

CERTIFICATE OF CORRECTION

PATENT NO. : 4,790,397

DATED : December 13, 1988

INVENTOR(S) : Oscar Kaalstad, et al.

It is certified that error appears in the above-identified patent and that said Letters Patent is hereby corrected as shown below:

ON THE TITLE PAGE:

After "[22] Filed: Aug. 21, 1986" on cover page, insert:

-- [30] Foreign Application Priority Data
April 21, 1987 United Kingdom.....8709437 --

Column 4, line 51, change "member, such" to
-- member. Such --

Signed and Sealed this

Twelfth Day of December, 1989

*Attest:*

JEFFREY M. SAMUELS

*Attesting Officer* *Acting Commissioner of Patents and Trademarks*